US007435142B1

(12) United States Patent
Hsu

(10) Patent No.: US 7,435,142 B1
(45) Date of Patent: Oct. 14, 2008

(54) NETWORK PLUG

(76) Inventor: Ching-Jen Hsu, Room303, 3F., No. 25, Sec. 1, Chang-an E. Road, Taipei (TW)

( * ) Notice: Subject to any disclaimer, the term of this patent is extended or adjusted under 35 U.S.C. 154(b) by 0 days.

(21) Appl. No.: 11/930,067

(22) Filed: Oct. 30, 2007

(30) Foreign Application Priority Data

Apr. 3, 2007 (CN) ..... 2007 2 0049933 U

(51) Int. Cl.
*H01R 24/00* (2006.01)

(52) U.S. Cl. ..... 439/676

(58) Field of Classification Search ..... 439/676, 439/594, 595, 596, 660, 752, 357, 358; 385/59
See application file for complete search history.

(56) References Cited

U.S. PATENT DOCUMENTS 4,225,209 A * 9/1980 Hughes ..... 439/344
5,562,475 A * 10/1996 Kern et al. ..... 439/344
5,579,425 A * 11/1996 Lampert et al. ..... 385/59
5,647,043 A * 7/1997 Anderson et al. ..... 385/78
5,888,100 A * 3/1999 Bofill et al. ..... 439/676
5,993,237 A * 11/1999 Kern et al. ..... 439/344
6,398,576 B1 * 6/2002 Hwang et al. ..... 439/354
6,848,949 B2 * 2/2005 Mullaney et al. ..... 439/676
7,153,168 B2 * 12/2006 Caveney et al. ..... 439/676

* cited by examiner

*Primary Examiner*—Chandrika Prasad

(57) ABSTRACT

The present invention relates to a technical field of high-speed network plug, and more particularly to an improved network plug. The network plug includes a short body, a one-piece holder, a core holder, a clip and a U-like metal housing. The core holder and the one-piece holder are disposed inside the short body. The lengths of the core holder and the one-piece holder are shortened to 4 mm and 3 mm respectively. The back portion of the clip is flexible and arc-like and has a rising and curved central portion. The rear end and the seat thereof are formed integrally. The front end of the clip is inserted in a slot located on a top side of the short body. The clip is fastened on the top side of the short body through a seat thereof. The network plug of the present invention is featured by simple structure, easy plug-out after plugging in a jack, low likelihood of damage to network plug and jack, good high-frequency property and support of demand for performance and speed.

10 Claims, 6 Drawing Sheets

NETWORK PLUG

FIELD OF THE INVENTION

The present invention relates to the technical field of a high-speed network plug, and more particularly to an improved network plug.

BACKGROUND OF THE INVENTION

The increasing speed of current network demands for a speed in around 10 Gbits/sec and a wider bandwidth which is generally above 500 MHz for CAT 6a and even higher than that for CAT 7. The network speed through regular network cable is hardly sufficient to meet the requirement of the industry, adding that it is essential for network cable structure to be simple and for user to easily and conveniently operate. Currently, the industry demand is still beyond the chase of the speed delivered by network cables produced by most manufacturers. A short body and a clip of regular network plugs are formed integrally. The fixing point of the clip structure is located at the front end of the short body. The clip must be pressed continuously upon plugging out of a jack until the short body is plugged out, thereby making the operation rather inconvenient. The major defect of such network plug lies in tough plug-out after the short body is inserted in a jack, which easily cause the damage of the network plug and the jack that could lead to the replacement of entire computer or hub, which increases the cost and causes significant trouble to user, particularly on its characteristics and speed issue.

SUMMARY OF THE INVENTION

An object of the present invention targets at providing a network plug with a special structure, ensuring that the network plug is easily plugged out after being plugged in a jack. The network plug and the jack are not easily damaged, and as a result of the good high-frequency characteristic, the demand for high-frequency characteristic and speed can be met as well.

To achieve the aforementioned object, the present invention is realized by virtue of the following technical solution: The network plug includes a short body, a one-body plastic plug, a core holder, a clip and a U-like metal housing, wherein the core holder and the one-piece holder are fitted in the short body, the one-piece holder is mounted to a rear end of the core holder, the clip is fixed on a top side of the short body through a seat thereof, a back side of said clip is flexible and arc-like and has a rising and curved central portion, a rear end of the clip and the seat thereof are integrally formed, a front end of said clip is movably inserted in a slot on a top side of a head of the short body, and the U-like metal housing is connected and fastened with the clip and the short body.

Preferably, a lower end, a left side and a right side of the short body are enveloped in the U-like metal housing, a top side of each of two lateral sides is folded inwardly to form a folded edge, and the folded edges are rested and clamped on the seat of the clip.

Preferably, a length of the core holder is 4 mm, and an inclination angle of an inclination portion is 45°.

Preferably, three columns of holes are opened on the one-piece holder, each of the first column and third column has an oval hole being vertically aligned, and the second column has two oval holes being horizontally aligned.

Preferably, a length of the one-piece holder is 3 mm.

Preferably, a holding portion is formed on a rear end of the one-piece holder, the holding portion is composed of two arc-like plates formed on two sides of the second column of hole, and an end portion of the holding portion is tapered.

Preferably, each of two metal sheets at a rear end of the U-like metal housing are bent inwardly to form a respective U-shaped trough, and two side panels of the U-like metal housing are ensured not to be split away while the U-like metal housing is filled with plastic material.

Preferably, a rear end of the folded edge is bent inwardly to form a U-shaped trough, and a rear end of the seat of the clip is inserted in U-shaped trough.

The network plug of the present invention includes a short body, a one-body plastic plug, a core holder, a clip and a U-like metal housing, wherein the core holder and the one-piece holder are fitted in the short body, a rear end of the clip and the seat thereof are integrally formed, a front end of said clip is movably inserted in a slot on a top side of a head of the short body, and the clip is fixed on a top side of the short body through the seat thereof. The present invention has the following advantages.

The clip is detached from the short body, and the clip can be removed from the short body: The fixing point of the clip structure is located at a rear portion of the short body; the front end of the clip is movable; between the front end of the clip and where the jack is supposed to be inserted in is the movement space; when pressing the clip to eject the network plug from the jack, the rear portion of the clip acts as a lever pivot and the clip acts as an arm of force so that it is labor-saving, easy and convenient to completely solve the occurrence that the network plug easily gets jammed inside the jack and is difficult to plug out of the jack and thus prevent from damaging the network plug and the jack.

The back portion of the clip is a flexible plate that is arc-like and resembles the back form of a dinosaur: Such special design prevents the clip from being easily entangled by other object. Hence, the clip is uneasy to be damaged or destructed, and the phenomenon that there is no force in support of the coupling of the short body and the jack and the contact between the network plug and the jack is defective won't take place, thereby getting rid off the chance that the transmission speed of the network plug fails to attain network speed requirement.

Force application range to the clip is wide. The position of the clip subjected to force application differs from that of the current RJ45 plug. The fixing point of the clip of the RJ45 plug is located at a front side of the crystal head, and the rear part of the clip is lifted up or good for sliding. Therefore, the applied force angle range of the clip of existing network plug is only up to 90°. The applied force angle range of the clip of the present invention is expanded up to 270°. The structural fixing point of the clip is mounted to the rear portion of the short body. Except the tail end, as long as there is a force acted upon the back side of the clip from any direction, the network plug can always be easy to plug out. Given the anti-slip slot on the clip and the counter acting force of the jack, the network plug is easily ejected by lightly pressing the clip instead of constantly pressing it.

The network plug of the present invention breaks the normal rule by dividing the network plug into several different parts and further assembling every part to form a complete plug. For example, there is a special U-like metal housing covering up the short body of a CAT7 plug, whose folded edges on both sides of the top portion are clamped and fixed on the seat of the clip with a jig; the end portions of two metal plates at the rear end of the U-like metal housing are bent inwardly to form a U-shaped trough; the U-shaped trough is filled with plastic material through molding so that both side panels of the U-like metal housing won't depart from both sides; thus, the U-like metal housing is tightly fastened on the short body to bundle the clip, the short body and the U-like metal housing in formation of a complete assembly and to solve the structural difference and the poor high-frequency characteristic frequently found in the assembly made by the CAT7 short body.

Superior performance: The core holder and the one-piece holder are modified in consideration of the networking and high-frequency properties as a whole to shorten the length of their main bodies, and the machining loss after the modification of the core holder and the one-piece holder can be alleviated as much as possible. Meanwhile, such design can increase the high-frequency anti-interference capability and enhance its high-frequency performance to meet the EIA/TIA CAT 6a/CAT7 standard.

DETAILED DESCRIPTION OF THE PREFERRED EMBODIMENT

Figure 1:
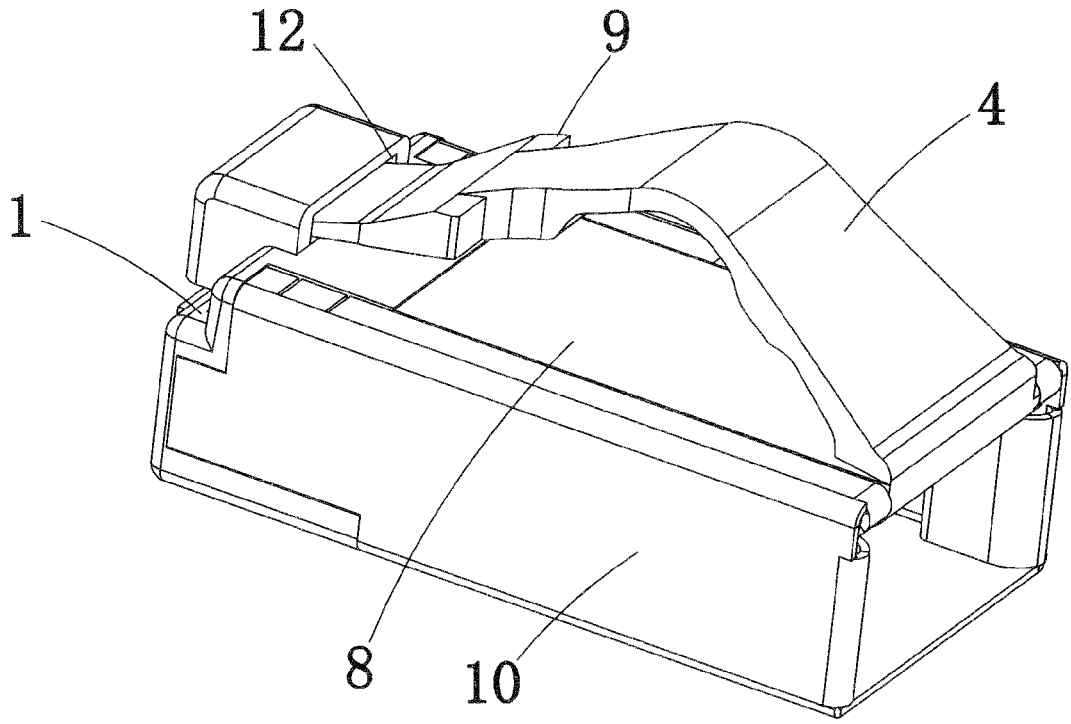
FIG. 1 is a structural schematic view of the present invention.
Figure 2:
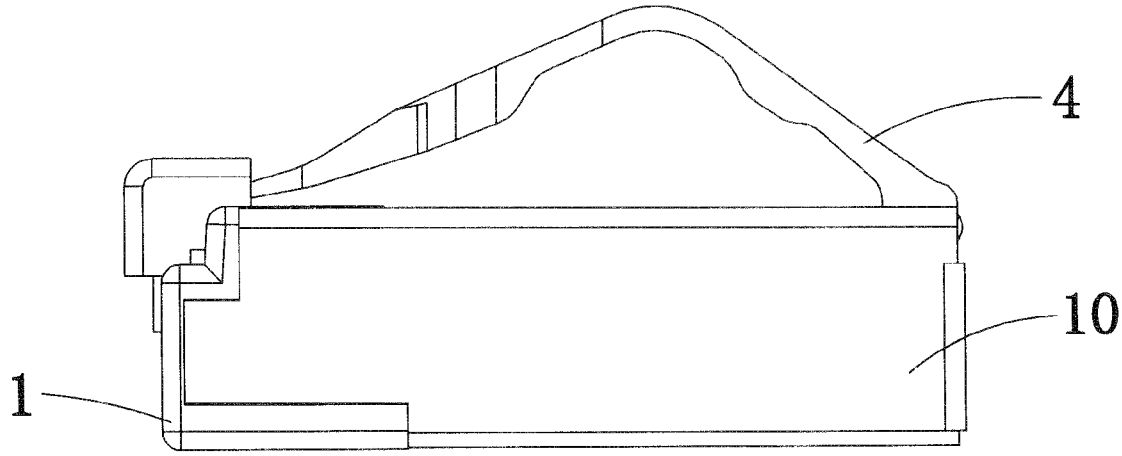
FIG. 2 is a front view of FIG. 1.
Figure 3:
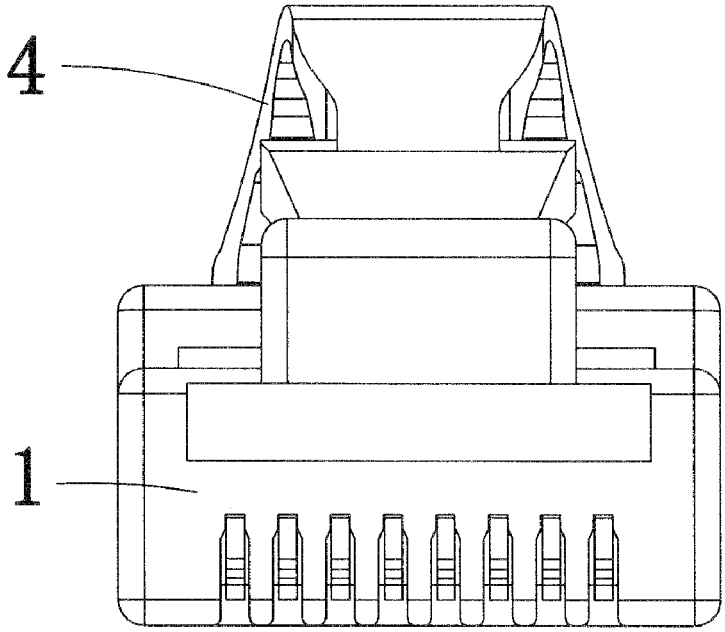
FIG. 3 is a left view of FIG. 2.
Figure 4:
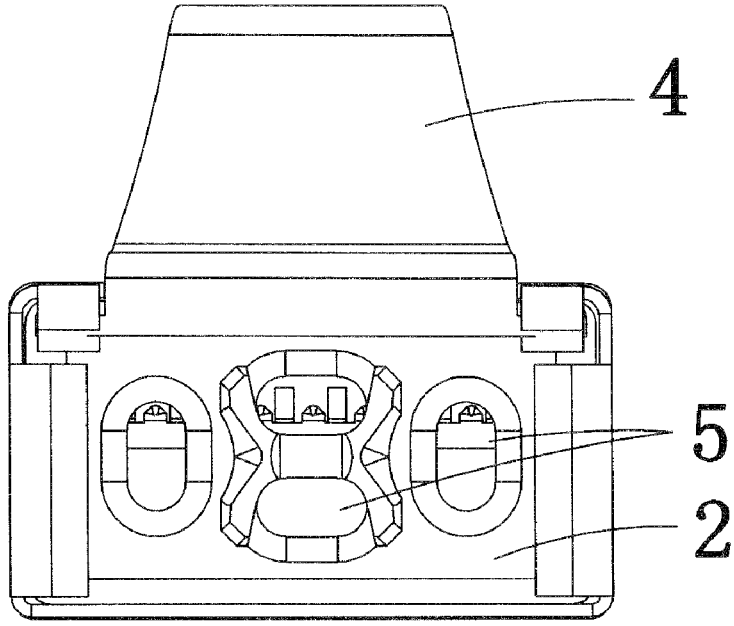
FIG. 4 is a right view of FIG. 2.
Figure 5:
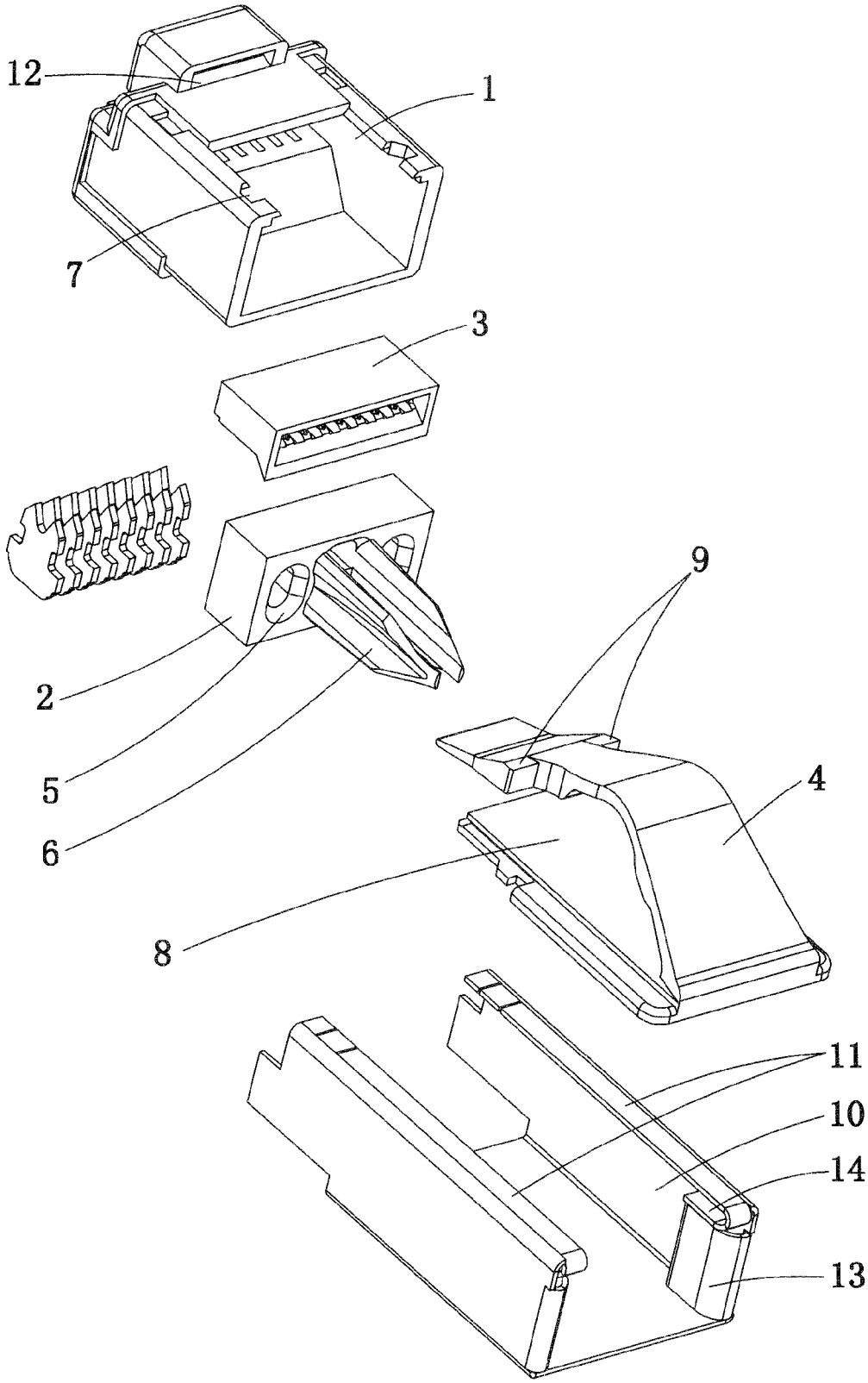
FIG. 5 is an exploded schematic view of the present invention.
Figure 6:
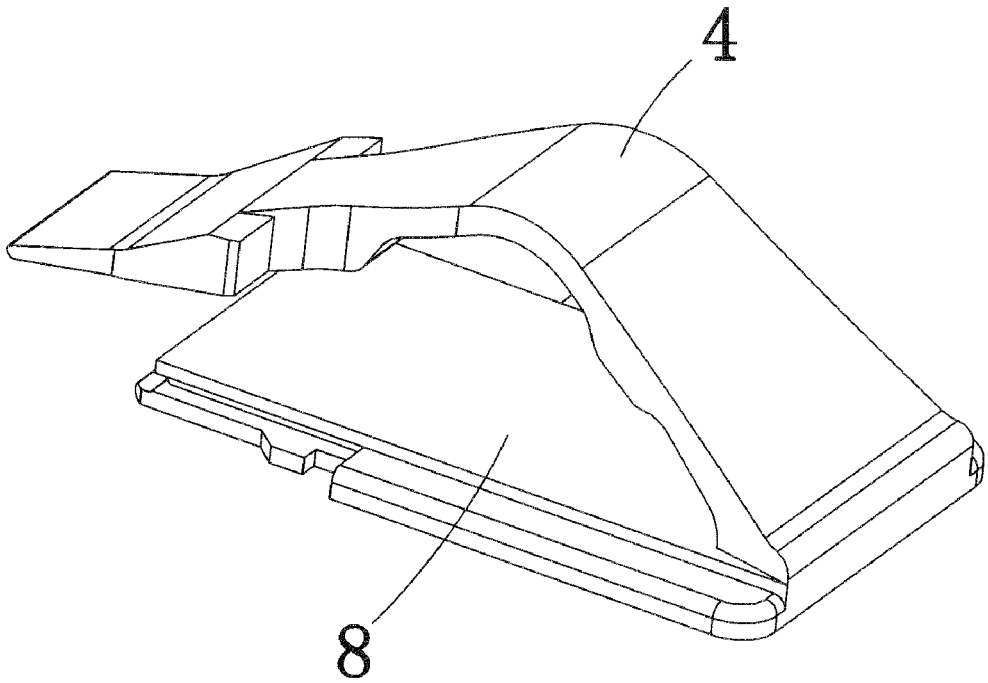
FIG. 6 is a structural schematic view showing the clip and the present invention.
Figure 7:
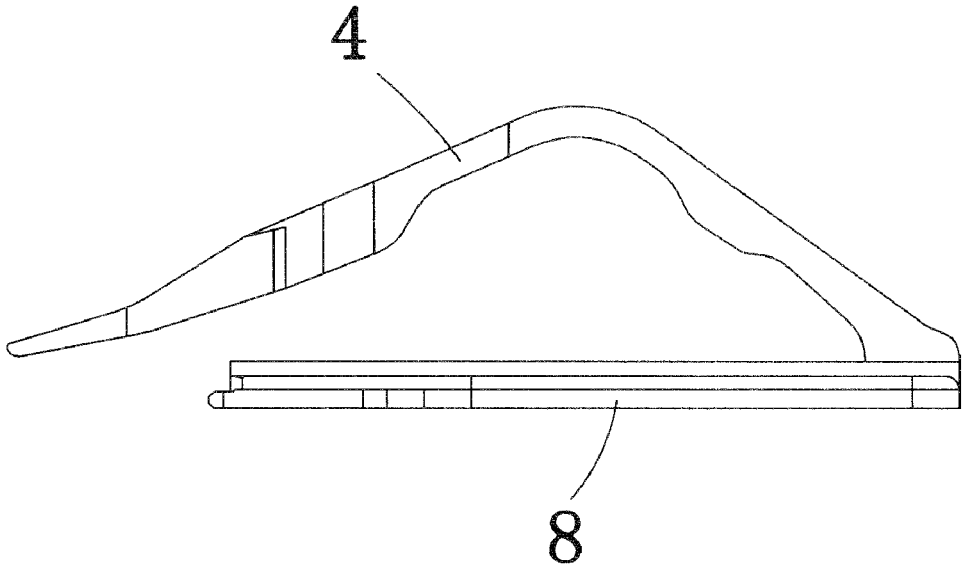
FIG. 7 is a front view of FIG. 6.
Figure 8:
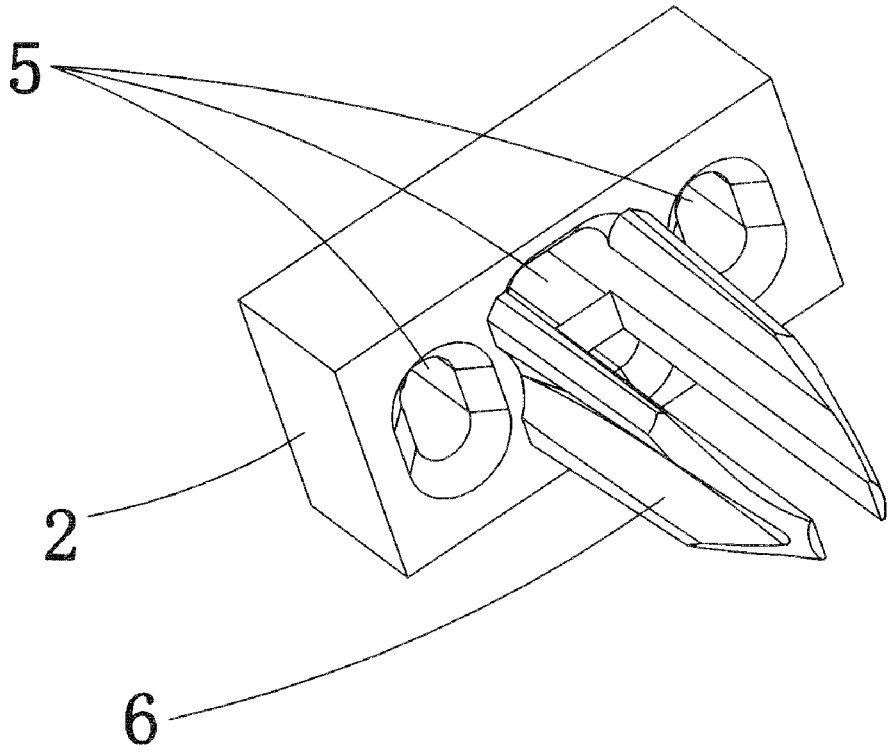
FIG. 8 is a structural schematic view showing the one-piece holder of the present invention.
Figure 9:
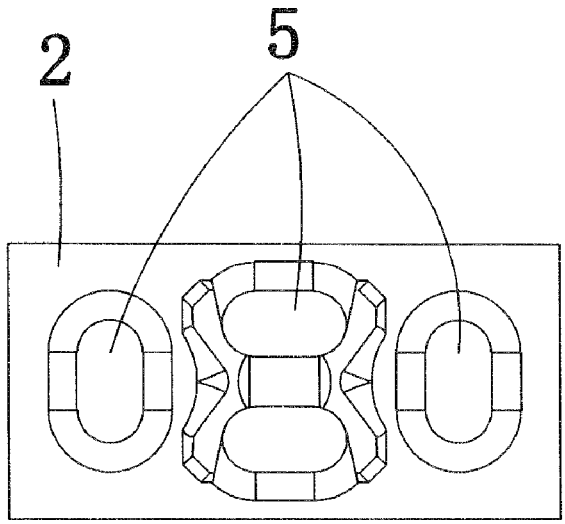
FIG. 9 is a front view of FIG. 8.
Figure 10:
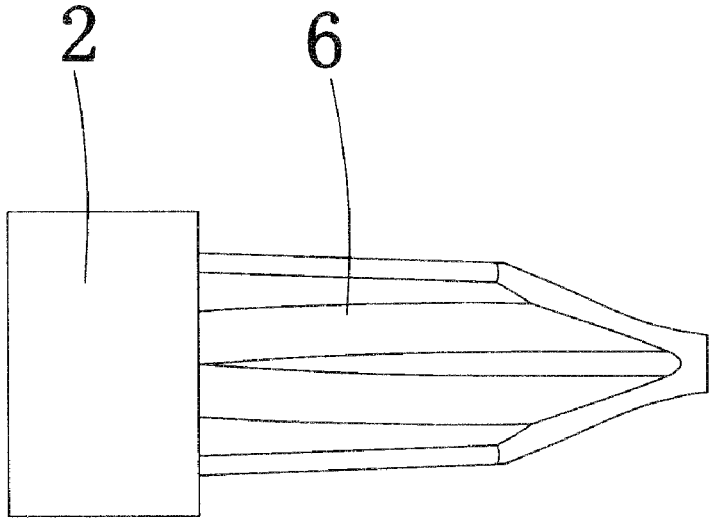
FIG. 10 is a left view of FIG. 9.
Figure 11:
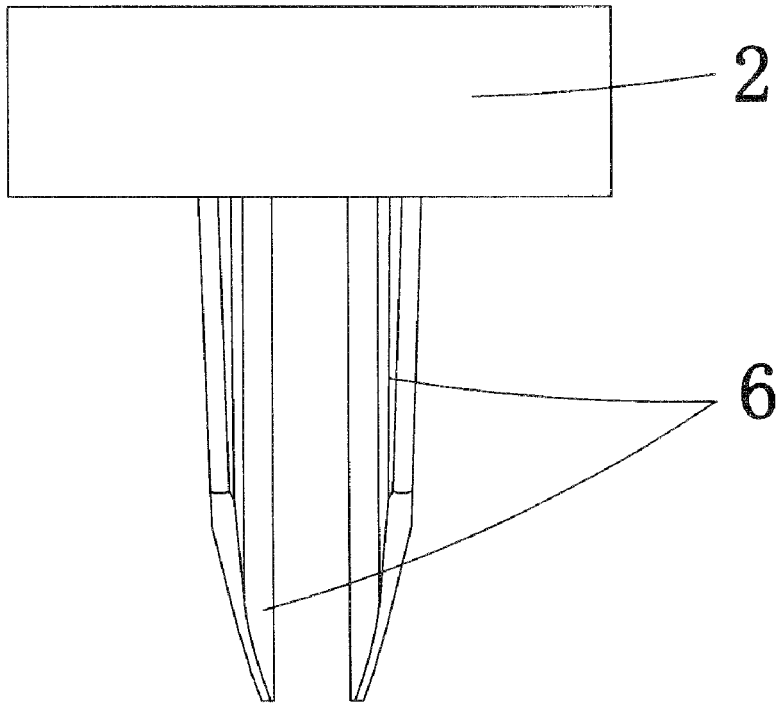
FIG. 11 is a top view of FIG. 9.

Please refer to FIGS. 1-11 for a preferred embodiment of the present invention. The network plug includes a short body 1, a one-piece holder 2, a core holder 3, a clip 4, and a U-like metal housing 10. The core holder 3 and the one-piece holder 2 are fitted in the short body 1. The one-piece holder 2 is mounted to a rear side of the core holder 3. The U-like metal housing 10 is used to fix the clip 4 and the short body 1.

The length of the core holder 3 is 4 mm and the inclination angle of an inclination portion is 45°. The length of the core holder 3 is shortened from original 5 mm to 4 mm. The core holder 3 with such specification enables the network plug to have a better stability and further ensures the stability of the network plug.

The one-piece holder 2 has three columns of holes 5 disposed thereon, wherein the first column and the third column has a vertically aligned oval hole respectively, and the second column has two horizontally aligned oval holes. If each core of the network cable is directly connected with the core holder 3 instead of being routed through the one-piece holder 2, signal interference will be generated among cores one another, thus lowering the transmission speed and transmission quality thereof. Consequently, before each core enters its core holder 3, let the cores in pairs penetrate through four holes of the one-piece holder 2 respectively. The one-piece holder 2 is employed to guide each core into the core holder 3 so as to avoid the signal interference issue generated among cores one another. The one-piece holder with such design can effectively avoid the signal interference generated among cores one another.

The length of the one-piece holder 2 is shortened from original 5 mm to 3 mm. The machining loss can be reduced when the length of the one-piece holder 2 is shortened. Such design can increase the high-frequency anti-interference capability of the network plug and thus enhance its high-frequency performance. So far, its characteristics can meet the EIA/TIA CAT 6a/CAT 7 standard.

A holding portion 6 is formed on the rear side of the one-piece holder 2. The holding portion 6 is composed of two arc-like plates formed on both sides of the second column of hole, and the end portion of the holding portion 6 is tapered to be pointed. The holding portion 6 of the one-piece holder 2 has two functions, namely a core separation function and a holding function. The core separation function is supported by two arc-like plates of the holding portion 6 to separate each pair of cores and prevent signal interference due to the intersection of cores. The holding function of the holding portion 6 prevents the cores at the connected location of the network cable and the crystal head from being easily bent or broken off when the end of the holding portion 6 is inserted in the network cable during the assembling process and the assembling process is finished.

The clip 4 is passed through the seat 8 thereof and is fixed on the top side of the short body 1. More specifically, the seat 8 of the clip 4 and top edges of the short body 1 are fixed and assembled together by matching engagement sections 7 located thereon, the clip 4 and the short body 1 are separable, and the clip 4 can be dismantled from the short body 1.

The back portion of the clip 4 is flexible and arc-like and has a rising and curved central portion. The rear end of said clip 4 and the seat 8 thereof are integrally formed. The front end of the clip 4 is movably inserted in a slot 12 on a top side of a head of the short body 1. A disengagement prevention section 9 is formed at the front end of the clip 4 such that the network plug is snapped in the mating jack by virtue of the disengagement prevention section 9 to prevent the network plug from automatically disengaging from the jack.

As the structural positioning point of the clip 4 is located at the rear portion of the short body 1 and the front end of the clip is movable, force can be exerted on any location of the clip 4 except the tail portion of the clip 4. As long as there is a force applied on the clip 4, due to the counter action force of the disengagement prevention section 9 and the jack, the network plug can be ejected by lightly pressing the clip 4. Such design enables the force application direction an effective range of 270°, while plugging in and plugging out the network plug, which is three folds of the effective force application range of only 90° for current network plug. Moreover, due to the movable front end, the front end of the clip 4 is extended forward while the back portion of the clip 4 is pressed down. When plugging out the network plug, little force is needed to unplug the network plug as a result of self-own counter action force, so as to have easy plug-in and plug-out. Meanwhile, such special design prevents the clip 4 from being easily entangled by other object and resulting in plug-out obstruction. As a consequence, the clip 4 is also uneasy to be damaged.

A U-like metal housing 10 is fixed with the bottom side of the short body 1 and wrapped up the bottom side and the left and right sides of the short body 1. A top side of each of two lateral sides is folded inwardly to form a folded edge 11, and the folded edges 11 are rested and clamped on the seat 8 of the clip 4 to fasten the clip 4 on the short body 1.

The U-like metal housing 10 is assembled after the assembly of all other parts is completed. The two folded edges 11 of the U-like metal housing 10 are tightly clamped and pressed on the seat 8 of the clip 4 by using a jig to fix the U-like metal housing on the short body 1. A rear end of the folded edge 11 is bent inwardly to form a U-shaped trough 14, and a rear end of the seat 8 of the clip 4 is inserted in the U-shaped trough 14, thereby ensuring that the clip 4 is firmly fastened on the short body 1.

Each of two metal sheets at a rear end of the U-like metal housing 10 is bent inwardly to form a respective U-shaped trough 13. While molding, the U-shaped trough 13 is filled with plastic material. The U-like metal housing 10 is tightly fixed on the short body 1 such that both sides of the U-like metal housing 10 won't be split away. The clip, short body, and the U-like metal housing are assembled to form a complete unit to reduce the splitting U-like metal housing 10 and accidental scratch. The U-like metal housing 10 can not only effectively protect network plug but also group the short body 1 and the clip 4 together, thereby fully overcoming the defect caused by normal machining method.

While the invention has been described in terms of what is presently considered to be the most practical and preferred embodiments, it is to be understood that the invention needs not be limited to the disclosed embodiments. On the contrary, it is intended to cover various modifications and similar arrangements included within the spirit and scope of the appended claims, which are to be accorded with the broadest interpretation so as to encompass all such modifications and similar structures.

What is claimed is:

1. An improved network plug, comprising: a short body (1), a one-piece holder (2), a core holder (3), a clip (4), and a U-like metal housing, wherein said core holder (3) and said one-piece holder (2) are fitted in said short body (1), said one-piece holder (2) is mounted to a rear end of said core holder (3), said clip (4) is fixed on a top side of said short body (1) through a seat (8) thereof, a back side of said clip (4) is flexible and arc-like and has a rising and curved central portion, a rear end of said clip (4) and said seat (8) thereof are integrally formed, a front end of said clip (4) is movably inserted in a slot (12) on a top side of a head of said short body (1), and said U-like metal housing is connected and fastened with said clip (4) and said short body (1).

2. The improved network plug as set forth in claim 1, wherein a bottom side, a left side and a right side of said short body (1) are enveloped in said U-like metal housing (10), a top side of each of two lateral sides is folded inwardly to form a folded edge (11), and said folded edges (11) are rested and clamped on said seat (8) of said clip (4).

3. The improved network plug as set forth in claim 1, wherein a length of said core holder (3) is 4 mm, and an inclination angle of an inclination portion is 45°.

4. The improved network plug as set forth in claim 1, wherein three columns of holes (5) are opened on said one-piece holder (2), each of said first column and third column having an oval hole being vertically aligned, and said second column having two oval holes being horizontally aligned.

5. The improved network plug as set forth in claim 1, wherein a length of said one-piece holder (2) is 3 mm.

6. The improved network plug as set forth in claim 1, wherein a holding portion (6) is formed on a rear end of said one-piece holder (2), said holding portion (6) is composed of two arc-like plates formed on two sides of said second column of hole (5), and an end portion of said holding portion is tapered.

7. The improved network plug as set forth in claim 1, wherein each of two metal sheets at a rear end of said U-like metal housing (10) is bent inwardly to form a respective U-shaped trough (13).

8. The improved network plug as set forth in claim 1, wherein a rear end of said folded edge (11) is bent inwardly to form a U-shaped trough (14), and a rear end of said seat (8) of said clip (4) is inserted in said U-shaped trough (14).

9. The improved network plug as set forth in claim 2, wherein each of two metal sheets at a rear end of said U-like metal housing (10) is bent inwardly to form a respective U-shaped trough (13).

10. The improved network plug as set forth in claim 2, wherein a rear end of said folded edge (11) is bent inwardly to form a U-shaped trough (14), and a rear end of said seat (8) of said clip (4) is inserted in said U-shaped trough (14).

* * * * *